US006602023B2

(12) United States Patent
Crescenzi et al.

(10) Patent No.: US 6,602,023 B2
(45) Date of Patent: Aug. 5, 2003

(54) LEACHING CHAMBER ENDPLATE

(75) Inventors: Donald C. Crescenzi, Killingworth, CT (US); James J. Burns, Deep River, CT (US); Daniel J. Swistak, Newmarket, NH (US)

(73) Assignee: Infiltrator Systems, Inc., Old Saybrook, CT (US)

( * ) Notice: Subject to any disclaimer, the term of this patent is extended or adjusted under 35 U.S.C. 154(b) by 0 days.

(21) Appl. No.: 09/730,509

(22) Filed: Dec. 5, 2000

(65) Prior Publication Data

US 2002/0067952 A1 Jun. 6, 2002

Related U.S. Application Data

(60) Provisional application No. 60/171,368, filed on Dec. 22, 1999.

(51) Int. Cl.[7] ..... E02B 13/02

(52) U.S. Cl. ..... 405/42; 405/43; 405/45; 405/46; 405/48; 405/49

(58) Field of Search ..... 405/39–40, 42–43, 405/45–46, 48–49; 285/4, 901, 921; 220/782, 784, 787, 790; 403/326, 328, 329

(56) References Cited

U.S. PATENT DOCUMENTS

| | | | | |
|---|---|---|---|---|
| 3,916,565 A | * | 11/1975 | Runyon | 405/43 X |
| 4,239,474 A | | 12/1980 | Nakagawa | |
| 4,493,229 A | | 1/1985 | Stewart et al. | |
| 4,555,043 A | * | 11/1985 | Bernhardt | 220/790 X |
| 4,643,657 A | | 2/1987 | Achelpohl et al. | |
| 4,738,612 A | | 4/1988 | Kikuchi et al. | |
| 4,750,411 A | * | 6/1988 | Eversole | 454/292 |
| 4,759,661 A | | 7/1988 | Nichols et al. | |
| 5,017,041 A | | 5/1991 | Nichols | |
| 5,156,488 A | | 10/1992 | Nichols | |
| 5,336,017 A | | 8/1994 | Nichols | |
| 5,399,050 A | * | 3/1995 | Jacobus | 405/229 |
| 5,513,445 A | | 5/1996 | Farrag | |
| 5,692,348 A | * | 12/1997 | Ambrosino | 405/43 X |
| 5,711,536 A | * | 1/1998 | Meyers | 285/4 |
| 5,806,896 A | * | 9/1998 | Sato et al. | 285/2 |
| 5,916,104 A | * | 6/1999 | Lucenet et al. | 52/791.1 |
| 6,116,455 A | * | 9/2000 | Rossman et al. | 220/575 |
| 6,173,998 B1 | * | 1/2001 | Bock | 285/319 |

FOREIGN PATENT DOCUMENTS

WO WO 98/53147 11/1998

OTHER PUBLICATIONS

"Blow Molding", Plastics Engineering, Dec. 1999, pp. 3–8.
EnviroChamber Cost Effective Solutions for On–Site Systems; HANCOR Technology Innovation Solutions (22 pages).
"Introducing . . . Bio Diffuser Stoneless Wastewater Disposal System", The Chamber Leach Field System (4 pages).
"For the Serious Treatment of On–Site Wastewater and/or Stormwater . . . Give Your Customer a High Quality, Cost Effective Cultec Chamber System", SE–12.WPD, 1997 Cultec, Inc. Engineering Manual (5 pages).

* cited by examiner

*Primary Examiner*—Heather Shackelford
*Assistant Examiner*—Sunil Singh
(74) *Attorney, Agent, or Firm*—Cantor Colburn LLP

(57) ABSTRACT

The leaching chamber endplate including snap connectors, pipe stops, pipe scores, drill guide(s), and a barrier that facilitates enhanced engagement between the endplate and leaching chamber. This endplate is preferably formed using a blow molding process that forms, in situ, the endplate, including the snap connectors and the barrier.

26 Claims, 4 Drawing Sheets

LEACHING CHAMBER ENDPLATE

This disclosure claims priority to U.S. Provisional Application No. 60/171,368, filed Dec. 22, 1999, which is hereby incorporated by reference herein in its entirety.

TECHNICAL FIELD

The present disclosure relates to chambers for dispersing liquids in soil, and especially relates to endplates for leaching chambers.

BACKGROUND

Molded plastic leaching chambers (also referred to as leaching conduits), especially those sold under the trademark Infiltrator®, have met substantial commercial success. Examples of such type of chambers are shown in U.S. Pat. No. 4,759,661 to May and Nichols; in U.S. Pat. No. 5,839,844 to Nichols and Coppes; and, in U.S. Pat. Nos. 5,017,041, 5,156,488 and 5,336,017 all to Nichols.

Generally, plastic leaching chambers are arch shaped, with corrugations running along the arch shape, and have open bottoms and sidewalls with perforations, typically slots. In use, chambers are placed in a trench in the soil, connected one to the other as a string. The two chamber openings, at the opposing ends of the string, are closed with endplates. One of the endplates is connected to a pipe and the chambers are buried. The liquid to be dispersed, e.g. storm water or effluent from a septic tank, is typically delivered to the buried chambers by gravity flow through a 4 inch pipe.

Liquid introduced into a chamber leaches into the soil, both by flowing downwardly and by flowing through the chamber sidewall perforations. Generally, it is desirable that the perforations be placed at as great an elevation as possible, to maximize the chamber's liquid dispersing capacity. Liquid may accumulate inside the chamber when the inflow is greater than the dispersal of liquid into the surrounding soil. Thus, it is desirable that a leaching chamber have capacity for such accumulation by filling to the maximum extent possible.

One useful leaching chamber and endplate is set forth in U.S. Pat. No. 5,839,844. Referring to FIG. 1, a portion of an arch shape cross section chamber 22 with a spaced-apart endplate 20 is shown just before insertion of the arch shape endplate body into the chamber open end 26. The chamber 22 has features like those taught by the patents referred to above. Peaks 16 and valleys 18 run across the arch comprising corrugations which give strength. Slots 24 run lengthwise along the opposing sidewalls. The chamber base 44 comprises two spaced apart flanges running lengthwise, with an open space therebetween, so soil 25, on which the chamber rests, is exposed to liquid entering the chamber.

The chamber open end 26 is adapted to receive and join to a mating chamber so a string of chambers may be created; or, to receive endplate 20. The endplate 20 has an arch shape portion, shaped to slip-fit into the open end 26. The endplate has tabs 28 which engage openings or depressions 30 on the interior of side wall of the chamber to hold it in place.

Although this system is particularly useful, there continues to be a need in the art for endplates which are easier to install, effective against soil intrusion, and which increase the structural integrity of the leaching system.

SUMMARY

The disclosure relates to an endplate, a method for making the endplate, and a leaching chamber system for dispersing fluids in soil. The endplate comprises: an inner wall and an outer wall defining a central portion having an interior channel, said central portion having a size and geometry similar to the leaching chamber size and geometry; and at least one connector disposed about the periphery of said central portion, said connectors capable of engaging the periphery of the leaching chamber.

The method of making the endplate comprises: melting a material to form parison; extruding said parison between mold halves; closing one end of said parison; blowing an inert gas into said parison to form a balloon; closing the mold halves to form the endplate.

Finally, the leaching chamber system comprises: at least one leaching chamber having a hollow interior with open ends, and sidewalls with perforations which enable fluid passage therethrough, said leaching chamber having a size and geometry; and an endplate disposed adjacent to and in intimate contact with the periphery of said leaching chamber at one end, said endplate comprising an inner wall and an outer wall defining a central portion having an interior channel, said central portion having a size and geometry similar to the leaching chamber size and geometry, and at least one connector disposed about the periphery of said central portion, said connector engaging the periphery of at least one end of said leaching chamber.

BRIEF DESCRIPTION OF THE DRAWINGS

Referring now to the drawings, which are meant to be illustrative, not limiting, and wherein like elements are numbered alike in the several Figures.

DETAILED DESCRIPTION OF THE INVENTION

Although the invention is described in terms of application and use of leaching chambers such as those described in the patents mentioned in the Background (which are hereby incorporated by reference), it is understood that the endplate is useable with other chamber designs. For instance, the invention will be shown in application to a chamber having a curved arch shaped cross-section. However, the term arch shape will encompass cross-sectional shapes such as trapezoid, triangle, rectangle, octagonal, hexagonal, and so forth. Furthermore, although the endplates are preferably formed as one piece, they may be assembled of separate pieces.

The endplate can be made from any material which is stable in the leaching environment and provides the desired structural integrity, including, but not limited to, thermoplastic and thermoset materials, or combinations thereof, with polyethylene, particularly high density polyethylene, with general characteristics similar to those seen heretofore in chambers, preferred. Typical densities exceed about 0.8 grams per cubic centimeter (g/cc), with about 0.9 to about 1 g/cc preferred, and about 0.94 to about 0.97 g/cc especially preferred. Some possible high density polyethylenes are: Alathon and Petrothene, commercially available from Equistar Chemicals, Houston, Tex.; Sclair and Novapol, commercially available from Nova Chemicals, Pittsburgh, Pa.; Martex and PCR, commercially available from Phillips Chemical, Bartlesville, Okla.; and Fortiflex, commercially available from Solvay Polyers, Houston, Tex.; and the like.

Figure 1:
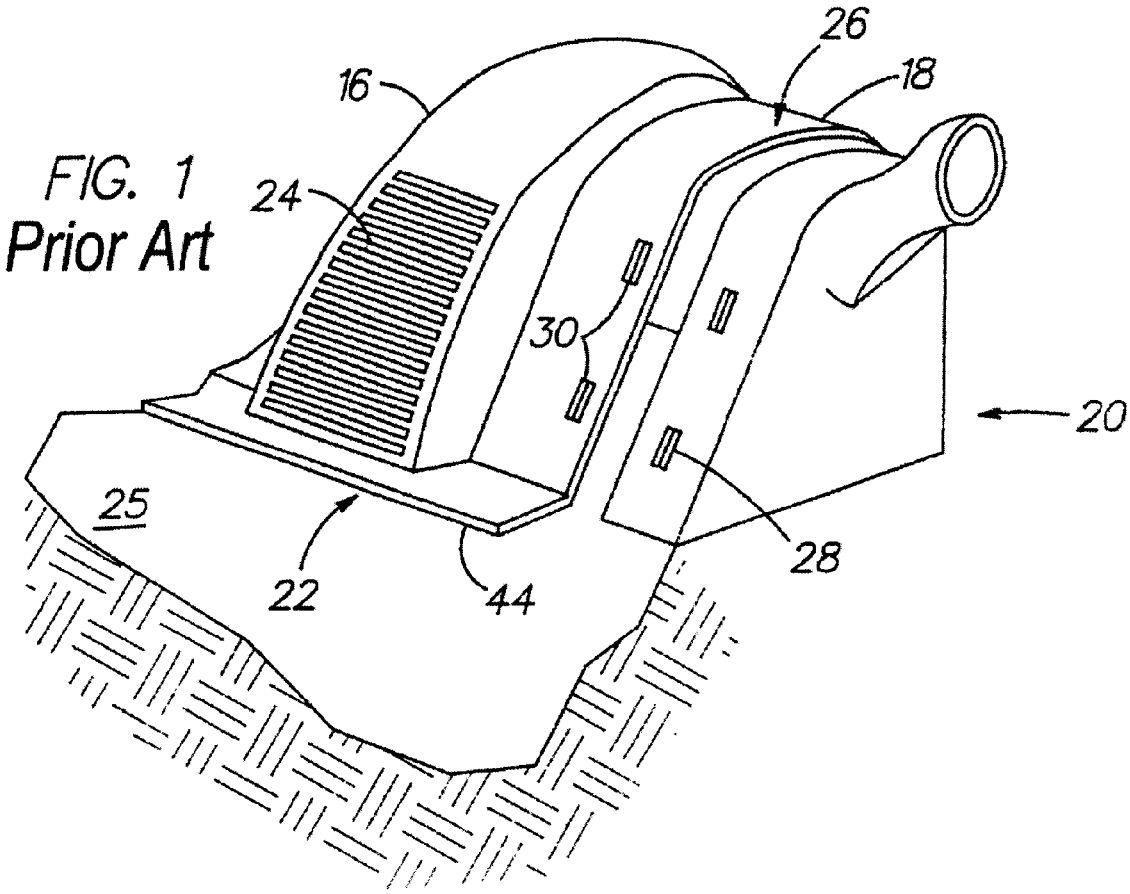
FIG. 1 Prior Art
FIG. 1 is an isometric, cut-away view of a prior art leaching chamber and endplate.
Figure 2:
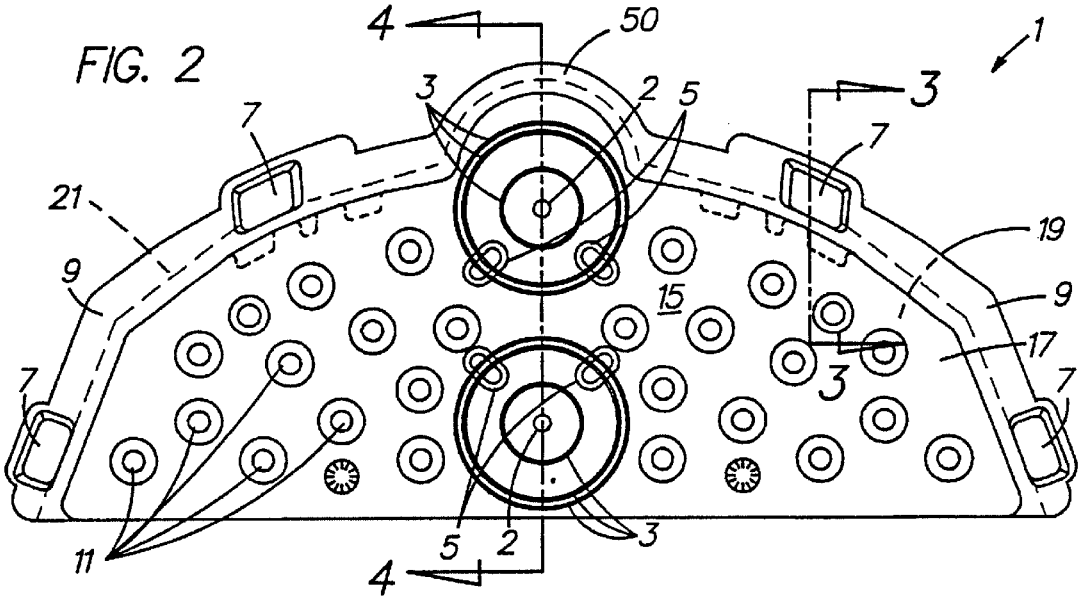
FIG. 2 is a plan view of one embodiment of an endplate.

FIG. 2 illustrates a plan view of an embodiment of the endplate 1. This endplate 1 includes: in the central portion 15, drill guide(s) 2, pipe guides or scores 3, pipe stops 5, and support stations 11; and along the periphery, snap connectors 7 and barrier 9. The pipe scores 3 are scores in the central portion 15 of the endplate 1 which set forth various pipe diameters and locations which can be utilized with the endplate 1. The pipe scores 3 can be formed to accept pipes having a diameter up to or less than the height of the endplate. Typical pipe diameters are up to about 6 inches, with storm drain applications employing pipes as large as 16 inches or more.

Preferably disposed in the center of each pipe score 3 is a drill guide 2. The drill guide, which is a dimple, indentation, or the like, sets forth the center of the pipe score, providing a guide to orient a drill or similar device when cutting the pipe score 3 to enable acceptance of a conduit or to form an exit point for fluid traveling through the endplate 1.

Once the desired pipe size and location has been determined, the endplate 1 can be cut along the appropriate pipe score 3, preferably by orienting the tip of the drill or similar device in the drill guide 2, to present an opening which will engage the fluid conduit or pipe 40; thereby forming a passageway through the endplate 1 for fluids to pass. In order to prevent blockage of the pipe 40 by the inner wall 19 (backside) of the endplate 1, the pipe stops 5 can be employed, thereby forming a pipe set-off from the backside. Although the pipe stops 5 are illustrated with relation to the top and bottom 4 inch pipe scores, they can be strategically located at any or all of the pipe scores 3. Furthermore, the pipe stops 5 can have any size and shape which will maintain a given distance between the pipe and the inner wall 19 of the endplate 1.

Figure 3:
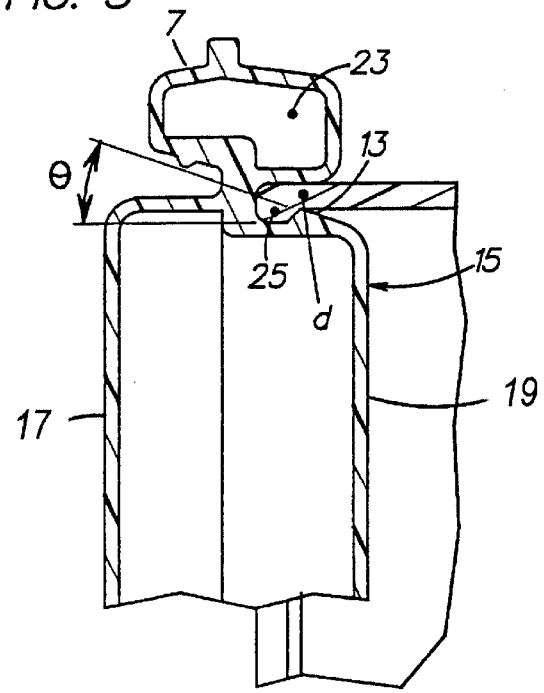
FIG. 3 is a cut-away cross-sectional view of a snap connector portion of one embodiment of an endplate.

Also preferably disposed within the central portion 15 of the endplate 1 are a plurality of support stations 11. These support stations (commonly known as "weld cones" or "tack offs") 11 increase the structural integrity of the endplate 1. Essentially, as is illustrated in FIG. 3, the endplate 1 can have two sides, the outer wall 17 and the inner wall 19, with an interior chamber defined thereby. In order to prevent either side from collapsing due to pressures of back-fill soil or fluids, respectively, support stations 11 can be disposed in the central portion 15 of the endplate 1. These support stations can be any amount, geometry and size which provides the desired structural integrity to the endplate 1. The support stations 11, illustrated in FIG. 2, have a substantially truncated conical geometry and form dimple-like impressions on both of the walls 17,19 of the endplate 1 such that opposite dimples face, and preferably, physically contact one another at substantially the midpoint between the two walls 17,19. Other possible geometries include elliptical, circular, trapezoidal, rectangular, conical, diamond, other multi-sided, and similar geometries, and combinations thereof.

In an alternative embodiment, the support stations 11 can be disposed on the interior of either the walls 17,19. These stations would preferably form a dimple like impression on the exterior surface of the wall and extend substantially through the interior channel to the interior surface of the opposing wall. Most preferably these stations would physically contact the opposing wall.

Disposed about the periphery of the endplate 1 can be a barrier 9 which inhibits soil invasion to the interior of the leaching chamber. This barrier 9 preferably has a sufficient size and geometry to substantially prevent soil from seeping between the endplate 1 and the leaching chamber 55 (see FIG. 5), and may optionally extend from the central portion 15 to beyond the snap connectors 7. Snap connectors 7 may be disposed on one or both sides barrier 9. In the embodiment illustrated in FIG. 2, dashed line 21 illustrates where the leaching chamber will contact the endplate 1 on the backside 19. As can be seen from the dashed line 21, the barrier 9 extends out from the intersection of the endplate 1 and the leaching chamber 55 a sufficient distance such that soil contacting the endplate 1 will not be forced between the junction of the endplate 1 and the leaching chamber. In one embodiment, the inner wall 19 is disposed within the leaching chamber 55, with barrier 9 extending thereabove. (See FIG. 4)

As is further illustrated by dashed line 21, snap connectors 7 are disposed about the periphery of the central portion 15, external to the leaching chamber when the endplate 1 is installed. Referring to FIG. 3, which is a cross-sectional view of section 3—3 from FIG. 2, the snap connectors 7 comprise a body 23 and an angled connector or tab 13 disposed so as to engage a lip or other protrusion, or an opening or depression formed about the leaching chamber periphery. The tab 13, which can be disposed on the snap connector 7 and/or the central portion 15, should have a sufficient size and geometry to retain engagement with the leaching chamber during backfilling of soil. Typically, tab 13, which restricts the opening between the connector 7 and said central portion 15, has a clip angle θ of up to about 45°, with about 10° to about 25° generally preferred.

The area 25 formed by tab 13 should have a size substantially similar to the size of the area of the leaching chamber to be engaged, with a size which enables a substantially firm engagement generally preferred. The distance "d" between the tab 13 and the central portion 15 of the endplate can be an amount conventionally employed for clipping mechanisms, with a distance which enables the securing of the endplate to the leaching chamber via the application of some pressure to move the attaching portion (e.g. lip) of the leaching chamber into area 25 preferred.

Figure 4:
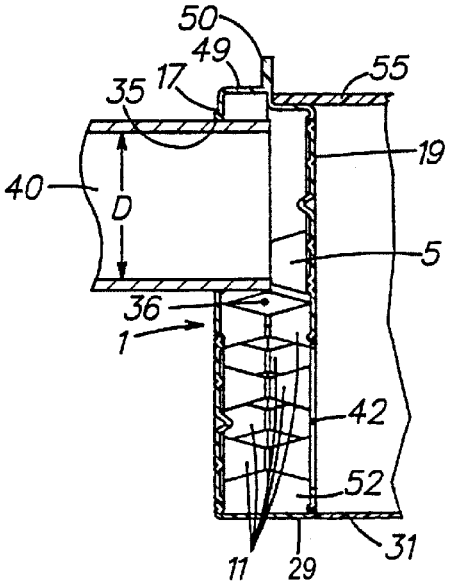
FIG. 4 is a cross-sectional view of one embodiment of an endplate-leaching chamber combination.
Figure 5:
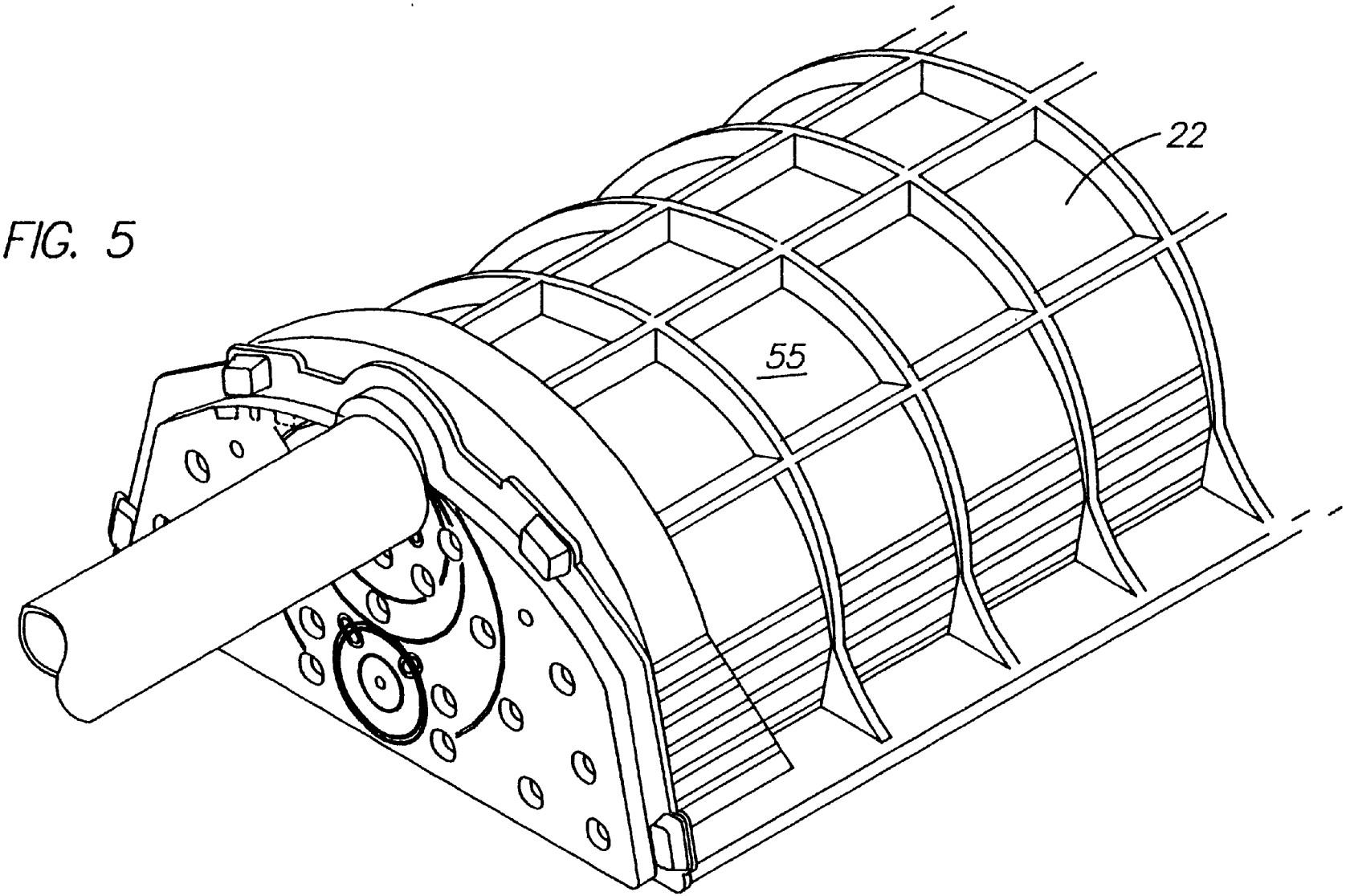
FIG. 5 is an isometric view of another embodiment of an endplate.
Figure 6:
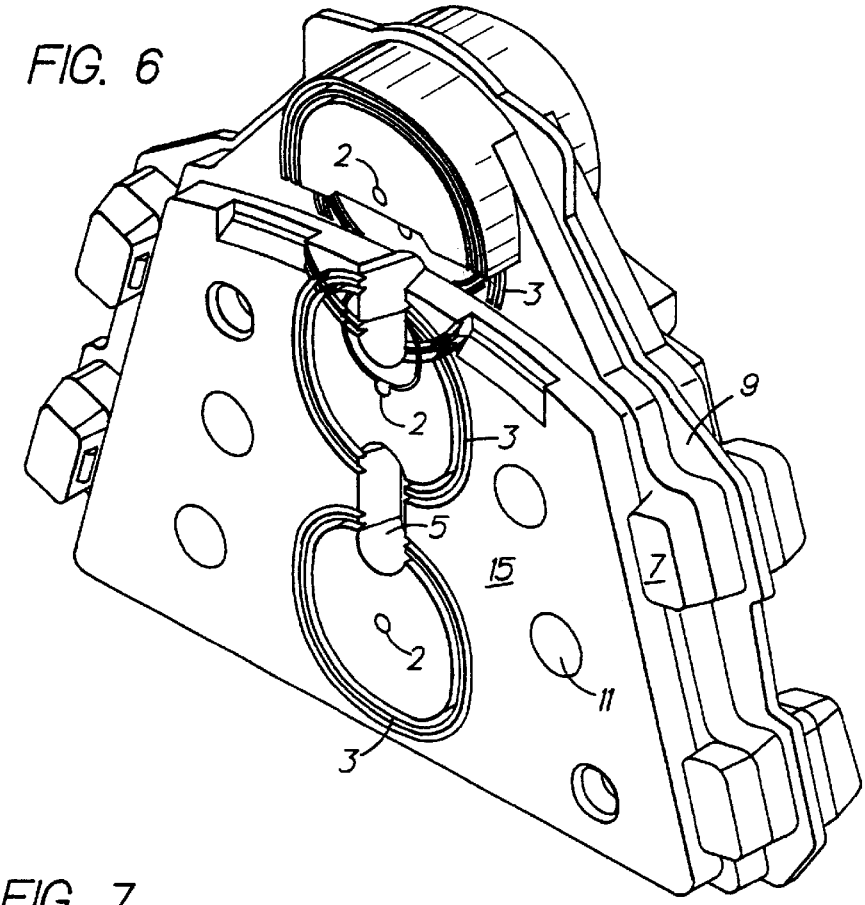
FIG. 6 is an isometric view of another embodiment of another endplate.
Figure 7:
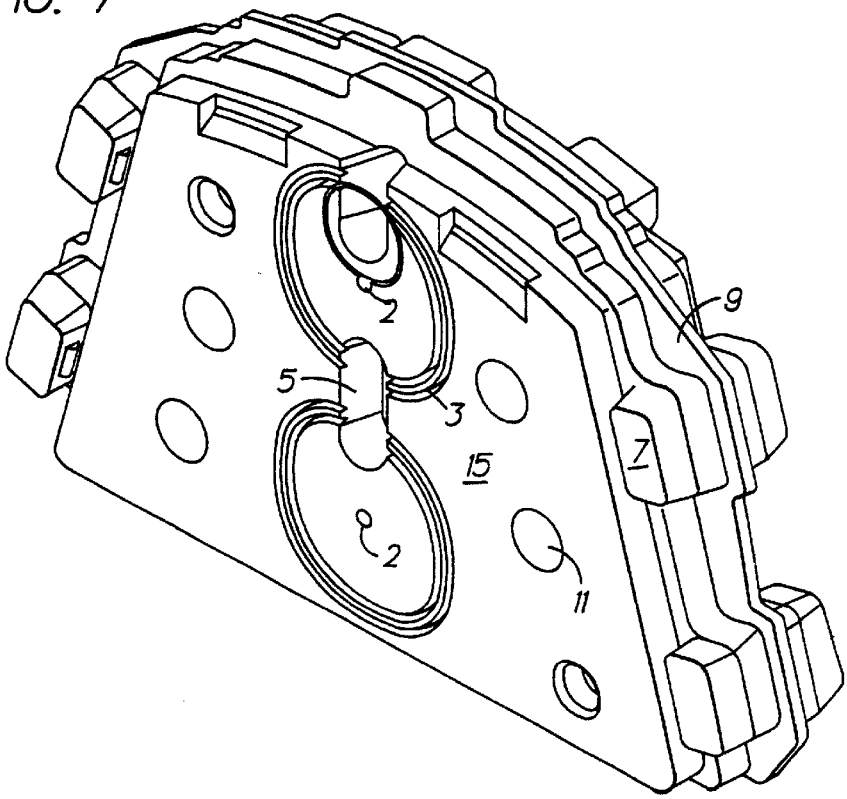
FIG. 7 is an isometric view of yet another embodiment of an endplate.

FIG. 4 shows a vertical centerline cross-section through the endplate of FIG. 2 as is shown by section 4—4, inserted into the open end of chamber 55, now shown in phantom. With reference to FIGS. 2 and 4, the arch shape portion of the endplate has a top 50. The endplate is hollow having an outer wall 17 and an inner wall 19, connected by sidewalls (not shown). The endplate walls 17,19 thus define an interior channel 36 running from top to bottom. The endplate can optionally have a short base 31, extending into the interior of the chamber.

Near the top of the arch shape portion of the endplate 1 is an opening 35 in the outer wall 17 from which liquid enters the top of the channel. The opening 35, formed from the appropriate pipe scores 3, is shaped to receive a round pipe 40 having an inside diameter D, shown in phantom. Liquid flowing from the duct and hole is guided vertically downward in the channel 36 formed in the arch shape portion of the endplate 1 by the inner and outer vertical walls 17,19 and opposing sloped endplate sidewalls, and lands on the base 29. The endplate 20, illustrated in FIGS. 4 and 5, has an opening 42 in the lower part of the inner wall 19, having a diameter preferably equal to or greater than the diameter D of the pipe 40. The inner wall opening 42 is preferably positioned a short distance above the bottom 29 of the endplate 1 Thus, there is a cavity 52 at the bottom of the endplate 1 where liquid can accumulate, along with any heavier particulate, to diminish the erosive force of descending liquid on the soil inside the chamber 55. Alternatively, a flange or longitudinal projection into the chamber 55 beyond the plane of inner wall 19 (extension 31) can be used in conjunction with the elevated opening 42 to further inhibit soil erosion by liquid entering the chamber 55 through the opening 42, or the opening 42 can be positioned at the bottom of the endplate 1 with the extension 31 projecting out from the bottom to inhibit soil erosion.

Although formation of the endplate can be accomplished by several known techniques such as injection molding, pressure forming, thermo-forming, blow molding, rotocasting, among other molding processes, blow molding the endplate (including the barrier and snap connectors, in situ) is preferred. For example, thermoplastic material is melted and extruded as a tube of the melted material (commonly known as parison) between two mold halves. Once the extrudate is the desired size, e.g., typically extruded past the bottom of the mold, the tube is "pinched off". An inert gas (such as nitrogen, argon, air, or another gas which is inert with respect to the particular material, or combinations thereof) is then introduced into the parison to form a "balloon". Meanwhile, the mold halves close with the parison balloon therebetween, introducing pressure on the parison and thereby causing it to form the shape of the mold, with the inert gas forming the interior of the endplate, and the snap connectors. In order to facilitate formation of the details of the endplate and to ensure the formation of the snap connectors, the mold halves are preferably greater than about 5 inches apart, with greater than about 8 inches apart preferred, and about 10 inches or greater preferred to produce endplates having a width of about 20 inches to about 50 inches or so, and a height of about 8 inches to about 30 inches or so.

During the formation of the endplate, when the mold halves are partially closed, e.g., about 5 inches or less apart, it is preferable to at least one gas inlet port and at least one gas outlet port. The gas inlet and outlet ports can continue to introduce and remove, respectively, gas to/from the interior of the balloon, maintaining a desired pressure within the balloon, and ensuring formation of the detailed areas of the endplate. Preferably, gas introduced via the gas inlet port is cooled, typically below room temperature (e.g. about 25° C.), with a temperature of about 5° C. or less preferred to reduce cycle time and facilitate cooling of the endplate.

The following example is hereby provided to for illustration purposes.

EXAMPLE

The following example was used to prepare a high density polyethylene endplate as is shown in FIG. 2 having a height of about 12 inches and a length of about 28 inches.

1,816 grams of HDPE was melted at 450° C. The parison was then extruded between two mold halves disposed about 10 inches apart, wherein one mold half comprised the geometry and features of the inner wall and the other mold half comprised the geometry and features of the outer wall. Once the parison had been extruded past the bottom of the mold halves, pinch plates are activated to pinch off the parison. Simultaneously, as the mold halves closed at a rate of 20 inches/minute, air at 100 pounds per square inch (psi) was blown into the parison from a blow pin disposed in the accumulator head. When the mold halves were within about 1 inch of closure, 4 auxiliary blow needles were inserted into the balloon (two inlet and two outlet needles). As the blow nozzle ceased the introduction of air, two of the inlet needles began the introduction of 5° C. air, while the outlet needles enabled circulation of blow air to improve internal cooling of the part. Once the endplate was cooled to a substantially rigid state, the mold halves opened and the endplate was stripped of its parison flash and ejected from the mold cavity.

For purposes of economies, it should be noted that both the inner and outer walls 17, 19 can be designed as the "outside" plate for a channel. In other words, the central portion 15 of the inner wall 19 can have one set of pipe scores, pipe stops, etc., while central portion 15 of the outer wall 17 can have the same or a different set of pipe scores, pipe stops, drill guides, etc.

The endplate provides numerous advantages over conventional endplates. Conventional endplates typically are slip-fit inside the leaching chamber with tabs which engage openings in the chamber. If, however, during shipping or other handling of the leaching chambers, the shape thereof has changed, the endplates may not fully, or even partially engage the chamber. As a result, during backfilling, these endplates may collapse onto the bottom of the leaching trench, allowing soil intrusion into the leaching chamber. In contrast, the snap lock endplate engages the leaching chamber around the outer periphery thereof. Consequently, not only does the endplate inhibit soil intrusion, it avoids collapse into the leaching chamber. Furthermore, if the shape of the leaching chamber has changed, e.g., during shipping, the endplate reshapes the chamber to its original shape because the snap connectors engage the periphery of the chamber pulling it back into shape. Additionally, soil intrusion is further inhibited via the use of the barrier disposed around the periphery of the endplate.

Other advantages include: the integral forming of the endplate and snap connectors, which reduces processing time and cost, and improves the structural integrity of the connectors and the connection formed therewith; the splash opening and/or plate which inhibits soil erosion on the interior of the leaching chamber.

While preferred embodiments have been shown and described, various modifications and substitutions may be made thereto without departing from the spirit and scope of the invention. Accordingly, it is to be understood that the present invention has been described by way of illustration and not limitation.

We claim:

1. A leaching chamber endplate, said endplate for use with a leaching chamber for dispersing liquids in soil, having a hollow interior with open ends, and sidewalls with perforations enabling passage of liquids therethrough, said leaching chamber having a size and geometry, said endplate comprising:

an inner wall and an outer wall defining a central portion having an interior channel, said central portion having a size and geometry similar to the leaching chamber size and geometry; and a connector disposed at a periphery of said central portion, said connector is adapted to capture an outer edge of the leaching chamber so that said connector contacts both an inner surface and an outer surface of the leaching chamber.

2. The leaching chamber endplate as in claim 1, further comprising at least one pipe score disposed on at least one of said inner wall and said outer wall.

3. The leaching chamber endplate as in claim 2, further comprising a drill guide disposed in the center of said at least one pipe score.

4. The leaching chamber endplate as in claim 1, further comprising a barrier disposed about the periphery of said central portion with said connector disposed in said barrier.

5. The leaching chamber endplate as in claim 4, wherein said barrier has a first side and a second side, and said connector disposed on said first side and said second side.

6. The leaching chamber endplate as in claim 1, further comprising an opening in said outer wall capable of receiving a fluid conduit, and an opening in said inner wall disposed below said outer wall opening.

7. The leaching chamber endplate as in claim 6, wherein said outer wall opening is disposed in an upper half of said outer wall, and said inner wall opening is disposed in a lower half of said inner wall.

8. The leaching chamber endplate as in claim 6, further comprising stops disposed on said inner wall, in said interior channel, and aligned with said outer wall opening, wherein said stops are capable of inhibiting physical engagement of the conduit with the inner wall.

9. The leaching chamber endplate as in claim 1, wherein said connector protrudes from said periphery, and a portion disposed between said periphery and said connector capable of receiving the outer edge of the leaching chamber has an angular lower surface which restricts the opening between said protrusion and said central portion.

10. The leaching chamber endplate as in claim 1, further comprising one or more support stations disposed within said central portion, wherein said one or more support stations protrude from both said inner wall and said outer wall into said interior channel.

11. The leaching chamber endplate as in claim 10, wherein said one or more inner wall support stations and said one more outer wall support stations are disposed such that they physically contact one another.

12. The leaching chamber endplate as in claim 1, further comprising one or more support stations disposed within said central portion, wherein said one or more support stations protrude substantially through said interior channel, from at least one of said inner wall, and said outer wall.

13. A leaching chamber system for dispersing liquids in soil, comprising:

a leaching chamber having a hollow interior with open ends, and sidewalls with perforations which enable fluid passage therethrough, said leaching chamber having a size and geometry; and an endplate disposed adjacent to and in intimate contact with an outer edge of said leaching chamber at one end, said endplate comprising an inner wall and an outer wall defining a central portion having an interior channel, said central portion having a size and geometry similar to the leaching chamber size and geometry, and said connector disposed at a periphery of said central portion, wherein said connector captures said outer edge of said leaching chamber so that said connector contacts both an inner surface and an outer surface of the leaching chamber.

14. The leaching chamber system for dispersing liquids in soil as in claim 13, wherein said endplate further comprises a barrier disposed about the periphery of said central portion with said connector disposed in said barrier.

15. The leaching chamber system for dispersing liquids in soil as in claim 14, wherein said barrier as a first side and a second side, and said connector disposed on said first side and said second side.

16. The leaching chamber system for dispersing liquids in soil as in claim 13, wherein said endplate further comprises an opening in said outer wall capable of receiving a fluid conduit, and an opening in said inner wall disposed below said outer wall opening.

17. The leaching chamber system for dispersing liquids in soil as in claim 16, wherein said outer wall opening is disposed in an upper half of said outer wall, and said inner wall opening is disposed in a lower half of said inner wall.

18. The leaching chamber system for dispersing liquids in soil as in claim 16, further comprising stops disposed on said inner wall, in said interior channel, and aligned with said outer wall opening, wherein said stops are capable of inhibiting physical engagement of the conduit with the inner wall.

19. The leaching chamber system for dispersing liquids in soil as in claim 13, wherein said connector protrudes from said periphery, and a portion disposed between said periphery and said connector capable of receiving the outer edge of the leaching chamber has an angular lower surface which restricts the opening between said protrusion and said central portion.

20. The leaching chamber system for dispersing liquids in soil as in claim 13, wherein said endplate further comprises one or more support stations disposed within said central portions, wherein said one or more support stations protrude from both said inner wall and said outer rail into said interior channel.

21. The leaching chamber system for dispersing liquids in soil as in claim 20 wherein said one or more inner wall support stations and said one or more outer wall support stations are disposed such that they physically contact one another.

22. The leaching chamber system for dispersing liquids in soil as in claim 13, wherein said endplate further comprises at least one pipe score disposed on at least one of said inner wall and said outer wall.

23. The leaching chamber system for dispersing liquids in soil as in claim 22, further comprising a drill guide disposed in the center of said at least one pipe score.

24. The leaching chamber system for dispersing liquids in soil as in claim 22, further comprising one or more support stations disposed within said central portion, wherein said one or more support stations protrude substantially through said interior channel, from at least of said inner wall and said outer wall.

25. A method of using a leaching chamber, comprising:

using an endplate comprising an inner wall and an outer wall defining a central portion having an interior channel, said central portion having a size and geometry similar to the leaching chamber size and geometry, and a connector disposed at the periphery of said central portion, said connector captures an outer edge of the leaching chamber so that said connector contacts both an inner surface and an outer surface of the leaching chamber;

passing fluid through slid endplate into said leaching chamber; and dispersing said fluid from said leaching chamber.

26. The method for using a leaching chamber as in claim 25, further comprising passing said fluid through said interior channel.

* * * * *

UNITED STATES PATENT AND TRADEMARK OFFICE

CERTIFICATE OF CORRECTION

PATENT NO. : 6,602,023 B2
APPLICATION NO. : 09/730509
DATED : August 5, 2003
INVENTOR(S) : Donald C. Crescenzi et al.

It is certified that error appears in the above-identified patent and that said Letters Patent is hereby corrected as shown below:

Column 4:
Line 13, after "sides", insert --of--;

Column 7:
Line 12, before "disposed", delete "connector" and insert therefor --connectors--;

Column 8:
Line 61, after "through", delete "slid" and insert therefor --said--.

Signed and Sealed this

Seventeenth Day of July, 2007

JON W. DUDAS
*Director of the United States Patent and Trademark Office*